US009136583B2

(12) United States Patent
Tadokoro

(10) Patent No.: US 9,136,583 B2
(45) Date of Patent: Sep. 15, 2015

(54) AUTOMOTIVE WINDOW ANTENNA

(75) Inventor: Shingo Tadokoro, Mie (JP)

(73) Assignee: Central Glass Company, Limited, Ube-shi (JP)

( * ) Notice: Subject to any disclaimer, the term of this patent is extended or adjusted under 35 U.S.C. 154(b) by 94 days.

(21) Appl. No.: 13/505,422

(22) PCT Filed: Nov. 19, 2010

(86) PCT No.: PCT/JP2010/070649
§ 371 (c)(1),
(2), (4) Date: May 1, 2012

(87) PCT Pub. No.: WO2011/077874
PCT Pub. Date: Jun. 30, 2011

(65) Prior Publication Data

US 2012/0249382 A1 Oct. 4, 2012

(30) Foreign Application Priority Data

Dec. 25, 2009 (JP) ..... 2009-293890

(51) Int. Cl.
*H01Q 1/12* (2006.01)
*H01Q 21/28* (2006.01)
*H01Q 5/40* (2015.01)

(52) U.S. Cl.
CPC ..... *H01Q 1/1271* (2013.01); *H01Q 1/1278* (2013.01); *H01Q 5/40* (2015.01); *H01Q 21/28* (2013.01)

(58) Field of Classification Search
CPC ..... H01Q 1/12; H01Q 1/32; H01Q 1/325; H01Q 1/3291; H01Q 1/1271; H01Q 1/1278
USPC ..... 343/704, 711, 712, 713
See application file for complete search history.

(56) References Cited

U.S. PATENT DOCUMENTS 5,461,391 A * 10/1995 Ohnishi et al. ..... 343/713
2005/0030235 A1 2/2005 Noguchi et al.

(Continued)

FOREIGN PATENT DOCUMENTS

EP 0 559 196 A1 9/1993
EP 0 591 957 A2 4/1994

(Continued)

OTHER PUBLICATIONS

The A.R.R.L. Antenna Book, American Radio Relay League, 1988, pp. 2-24 to 2-25.*

(Continued)

*Primary Examiner* — Robert Karacsony
*Assistant Examiner* — Daniel J Munoz
(74) *Attorney, Agent, or Firm* — Crowell & Moring LLP

(57) ABSTRACT

An automotive window antenna includes: an FM radio main antenna which includes two horizontal strips, and a vertical strip, and which is connected with a main feed point provided on a side of a longitudinal side of the window glass through a strip extending inwardly between the horizontal strips from one end portion or a midpoint portion of one of the horizontal strips; and an FM radio sub antenna which includes one horizontal strip, and which is provided on a side opposite to the feed point, at a substantially central position between the two horizontal strips of the FM radio main antenna so as not to achieve a capacitive coupling with the two horizontal strips, the FM radio main antenna and the FM radio sub antenna being provided in the blank space to achieve a diversity reception, and being connected to a tuner.

4 Claims, 4 Drawing Sheets

(56) References Cited

U.S. PATENT DOCUMENTS

| | | | | |
|---|---|---|---|---|
| 2008/0106480 | A1* | 5/2008 | Nagayama et al. | 343/713 |
| 2010/0328170 | A1* | 12/2010 | Kuehne et al. | 343/712 |
| 2011/0115681 | A1* | 5/2011 | Oshima et al. | 343/713 |

FOREIGN PATENT DOCUMENTS

| | | | |
|---|---|---|---|
| EP | 0 856 904 | A2 | 8/1998 |
| EP | 1 841 007 | A1 | 10/2007 |
| JP | 8-321711 | A | 12/1996 |
| JP | 10-256817 | A | 9/1998 |
| JP | 10-276025 | A | 10/1998 |
| JP | 11-284421 | A | 10/1999 |
| JP | 2005-26905 | A | 1/2005 |
| JP | 2008-35412 | A | 2/2008 |

OTHER PUBLICATIONS

International Search Report with English translation dated Feb. 8, 2011 (five (5) pages).
Form PCT/ISA/237 (four (4) pages).
European Search Report dated Feb. 19, 2013 (six (6) pages).

* cited by examiner

AUTOMOTIVE WINDOW ANTENNA

TECHNICAL FIELD

This invention relates to a glass antenna for receiving AM/FM radio broadcast wave band, which is provided to a rear window glass of an automobile, and more specifically to a diversity reception by two glass antennas for an FM radio.

BACKGROUND OF THE INVENTION

Hitherto, glass antennas for receiving AM radio broadcast waves and FM radio broadcast waves achieve higher gains as areas surrounded by antenna strips become larger. Accordingly, these glass antennas are often provided on the rear window glass of the automobile which is easy to ensure a large area for obtaining a good reception gain. Furthermore, the rear window glass of the automobile is often formed on its central region with defogging heater strips (defogger) for ensuring rear visibility at the driving in the rain. Therefore, in case that the glass antenna is formed on the rear window glass, it has been forced to be formed in a blank space above or below the defogging heater strips.

For example, Japanese Patent Application Publication No. 2008-35412 discloses a glass antenna for a sedan-type automobile which is provided in blank spaces above and below defogging heater strips of a rear window glass of the automobile. This antenna includes a grounded antenna for AM/FM radios which is provided in the blank space above the defogging heating strips, and a grounded sub antenna for FM radio which is provided in the blank space below the defogging heating strips. Horizontal strips of the sub antenna are disposed to be apart from horizontal heating strips of the defogging heater strips, and/or horizontal strips bifurcating and extending from the horizontal heater strips of the defogging heater strips so as not to generate dip in the frequency characteristic. The interference by a metal frame of a movable backseat is prevented, and thereby the generation of the dip is prevented (Patent Document 1).

Moreover, Japanese Patent Application Publication No. 11-284421 discloses a glass antenna for a vehicle which uses, as an antenna, a defogger constituted by a plurality of heating conductive strips disposed on a rear window glass of the vehicle, and bus bars disposed on outsides of the heating conductive strips. In this glass antenna, a loop element is disposed in a blank space above or below the defogger. This element is directly connected with a part of the defogger. The electric power is fed from this element (Patent Document 2).

Moreover, Japanese Patent Application Publication No. 8-321711 discloses a high frequency glass antenna. The high frequency glass antenna includes an antenna conductor provided on a glass sheet of a window of an automobile, and another antenna conductor (6) which is provided on the glass sheet of the window of the automobile, and which is disposed adjacent to the antenna conductor with a predetermined distance so as to achieve the capacitive coupling. Moreover, the high frequency glass antenna includes another antenna conductor (16) which is provided on the glass sheet of the window, and is different from the antenna conductor and the antenna conductor (6). The antenna conductor (6) has a loop shaped portion in the electrical sense. The antenna conductor (6) is disposed adjacent to the antenna conductor (16) with a predetermined distance so as to achieve the capacitive coupling. Furthermore, the antenna conductor (16) is disposed adjacent to an opening portion (100) of an automobile body with a predetermined distance to achieve the capacitive coupling (Patent Document 3).

PRIOR ART DOCUMENT

Patent Document

Patent Document 1: Japanese Patent Application Publication No. 2008-35412

Patent Document 2: Japanese Patent Application Publication No. 11-284421

Patent Document 3: Japanese Patent Application Publication No. 8-321711

SUMMARY OF THE INVENTION

In the patent documents 1 and 2, the main antenna for receiving the AM/FM radio broadcast waves is provided in the blank space above the defogging heater strips of the rear window glass of the automobile, and the sub antenna for receiving the FM radio broadcast wave is provided in the blank space below the defogging heater strips. The FM main antenna and the FM sub antenna are arranged to achieve the diversity reception. However, even though the sub antenna for receiving the FM radio broadcast wave is provided in the blank space below the defogger, it is not possible to obtain the high reception gain. Accordingly, there is a problem that the sufficient diversity effects cannot be obtained.

Moreover, in the patent document 3, the AM/FM radio broadcast wave receiving antenna 6 is provided in the upper blank space to achieve the capacitive coupling with the defogger of the rear window glass of the automobile. Furthermore, the FM radio broadcast wave receiving antenna 16 is provided adjacent to the antenna 6 to achieve the capacitive coupling with the upper side of the antenna 6. The FM radio broadcast wave receiving antenna 6 and the FM radio broadcast wave receiving antenna 16 are intentionally disposed adjacent to each other to achieve the capacitive coupling, so as to utilize mutual radio waves. However, in a case where the antennas with the same frequency band are adjacent to each other, there is a problem that the diversity effect is decreased by half due to the mutual interference.

It is, therefore, an object of the present invention to solve the above-described problems, that is, to obtain good reception characteristic and good directional characteristic when a main antenna and a sub antenna for receiving FM radio broadcast wave which are disposed in a blank space of a defogger of a rear window glass of an automobile are provided to achieve diversity reception.

That is, the present invention is an automotive window antenna which is an AM/FM radio glass antenna provided in a blank space above heating conductive strips of a rear window glass of the automobile, the automotive glass window antenna including: an FM radio main antenna which at least includes at least two of horizontal strips that are apart from each other, and a vertical strip connected at positions near substantially central points of the horizontal strips, and which is connected with a main feed point provided on a side of a longitudinal side of the window glass through a strip extending inwardly between the horizontal strips from one end portion or a midpoint portion of one of the horizontal strips; and an FM radio sub antenna which includes at least one horizontal strip, and which is provided on a side opposite to the feed point of the FM radio main antenna, at a substantially central position between the two horizontal strips of the FM radio main antenna so as not to achieve a capacitive coupling with the two horizontal strips which are apart from each other, the FM radio main antenna and the FM radio sub antenna being provided in the blank space above the heating conductive strips to achieve a diversity reception, and being connected to a tuner.

Alternatively, the present invention is the automotive window antenna wherein the FM radio sub antenna is disposed to be apart from the horizontal strips of the FM radio main antenna by 15 mm or more.

Alternatively, the present invention is the automotive window antenna wherein a main one of the horizontal strips of the FM radio sub antenna has a length of 360 mm-480 mm in case of a frequency of 76-90 MHz for Japanese domestic band, and a length of 280 mm-400 mm in case of a frequency of 88-108 MHz for foreign band.

Alternatively, the present invention is the automotive window antenna wherein the automotive window antenna further comprises a strip of a U-shape, a reverse U-shape, or a rectangular closed shape, or a strip formed by combing these shapes, which is located between a tip end or the midpoint portion of the one of the horizontal strips of the FM radio main antenna, and the main feed point.

Alternatively, the present invention is the automotive window antenna wherein the FM radio sub antenna includes a rectangular closed loop strip, or a return strip returned from a tip end of the horizontal strip.

The FM radio main antenna and the FM radio sub antenna were provided in the blank space above the defogger of the rear window glass of the automobile to achieve the diversity reception. With this, it was possible to attain the good reception characteristic and the good directional characteristic.

Moreover, it was possible to considerably decrease the man-hour necessary for the tuning, and to decrease the man-hour for the development, relative to the conventional pattern in which the FM radio sub antenna was provided in the blank space below the defogger. Moreover, it was possible to simplify the pattern of the FM radio sub antenna.

DETAILED DESCRIPTION

Figure 1:
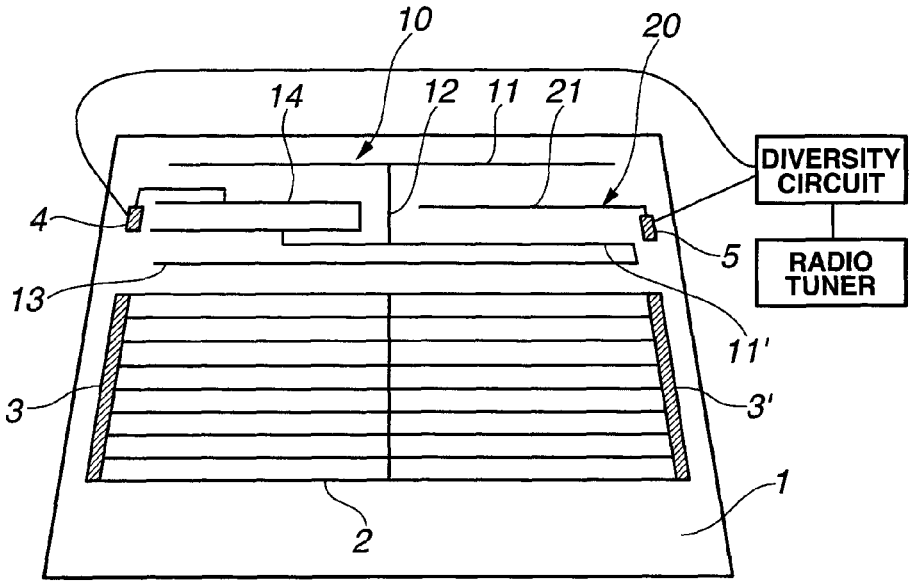
FIG. 1 is a front view showing a glass antenna according to a first embodiment of the present invention.

As shown in FIG. 1, a glass antenna according to the present invention includes two FM antennas of an FM radio main antenna 10 and an FM radio sub antenna 20. These FM radio main antenna 10 and FM radio sub antenna 20 are disposed in a blank space above heating conductive strips 2 of a rear window glass 1 of an automobile. The two FM antennas 10 and 20 are connected through a diversity circuit to a tuner.

The FM radio main antenna 10 at least includes at least two horizontal strips 11, 11•• which are apart from each other; and a vertical strip 12 connected at positions near substantially central points of the horizontal strips 11, 11••. In this FM radio main antenna 10, a strip extending inwardly between the horizontal strips 11, 11 from one end portion of one of the horizontal strips 11, 11•• is connected with a main feed point 4 provided on a side of a longitudinal side of the window glass 1. The FM radio main antenna 10 alone is also used as a receiving antenna for an AM radio broadcast wave band, and connected with an AM tuner (not shown).

It is optional to provide a return strip 13 extending from a tip end of one of the horizontal strips 11 extending in a direction opposite to main feed point 4 of the FM radio main antenna 10, parallel to the one of the horizontal strips 11. In this case, it is preferable that the return strip 13 is returned outwardly of the two horizontal strips 11 and 11 which are disposed to be apart from each other. However, in a case where a distance to a horizontal strip 21 of the FM radio sub antenna 20 can be ensured, the return strip 13 may be returned inwardly between the two horizontal strips 11 and 11 which are disposed to be apart from each other.

Moreover, it is preferable that main one of the horizontal strips 21 of the FM radio sub antenna 20 has a length of 360 mm-480 mm in case of a frequency of 76-90 MHz for Japanese domestic band, and a length of 280 mm-400 mm in case of 88-108 MHz for a foreign band, since it is possible to obtain a good reception sensitivity. The length of the main one of the horizontal strips 21 is a length of one of the horizontal strips 21 which is longer than the other horizontal strips 21 in case where there are the plurality of the horizontal strips 21, 21••.

Moreover, the strip may extend inwardly between the horizontal strips 11 and 11 through a strip of one of a U-shape, a reverse U-shape, and a rectangular loop shape (a rectangular shape) which is formed by bifurcating from the one end portion or the midpoint portion of one of the horizontal strips 11 and 11 of the FM radio main antenna 10, or through a strip formed by combing the above-described shapes, and may be connected with the main feed point 4 provided on the side of the longitudinal side of the window glass 1.

The strip extending from the end portion or the midpoint portion of uppermost one of the horizontal strips 11 which are the strips of one of the U-shape, the reverse U-shape, or the rectangular loop shape (the rectangular shape), or the strips formed by combining these shapes, and the strip similarly extending from the end portion or the midpoint portion of lowermost one of the horizontal strips 11 which are the strips of the one of the U-shape, the reverse U-shape, or the rectangular loop shape (the rectangular shape), or the strips formed by combining these shapes are connected with the main feeding point 4 of the FM radio main antenna 10, or the end portion or the midpoint portion of the one of the horizontal strips 11 of the FM radio main antenna 10.

On the other hand, the FM radio sub antenna 20 is provided at a position opposite to the main feed point 4 of the FM radio main antenna 10 at a substantially central position between the horizontal strips 11 of the FM radio main antenna 10 to ensure a distance so as not to achieve the capacitive coupling with the two horizontal strips 11 and 11 which are apart from each other. The FM radio sub antenna 20 includes at least one horizontal strip 21. The FM radio sub antenna 20 is connected with a sub feed point 5 provided on a side of the longitudinal side.

The FM radio sub antenna 20 may be a rectangular closed loop strip, or a strip having a return strip returned from the tip end of the horizontal strip.

It is preferable that the FM radio sub antenna 20 is disposed to be apart from each of the horizontal strips 11 and 11 of the FM radio main antenna 10 by 15 mm or more.

Figure 7:
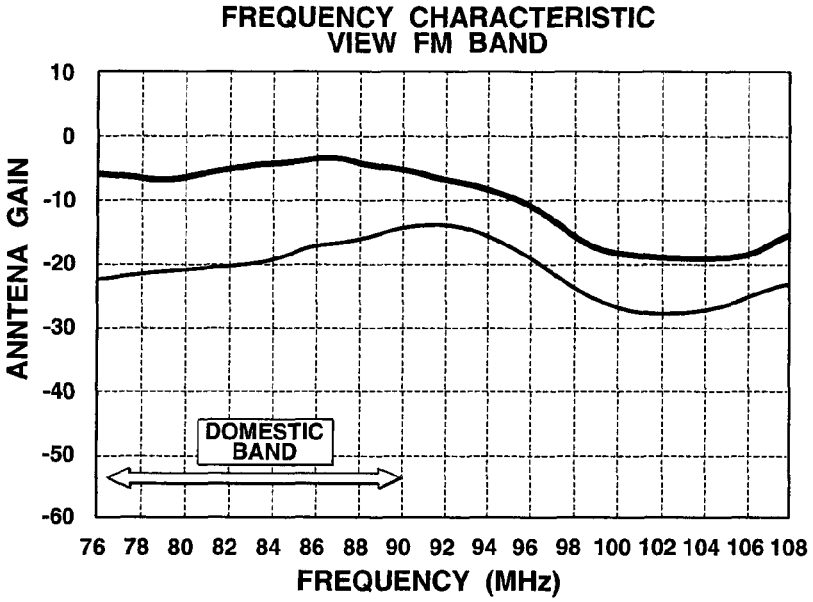
FIG. 7 is a frequency characteristic view of an FM radio broadcast wave band in the glass antenna according to the first embodiment of the present invention.

In FIG. 7, in the frequency band of 76-90 MHz of the FM radio broadcast for the Japanese domestic use, a frequency characteristic of the FM radio main antenna 10 alone according to the first embodiment shown in FIG. 1 is represented by a bold solid line, and a frequency characteristic of the FM radio sub antenna 20 alone is represented by a thin solid line.

Figure 6:
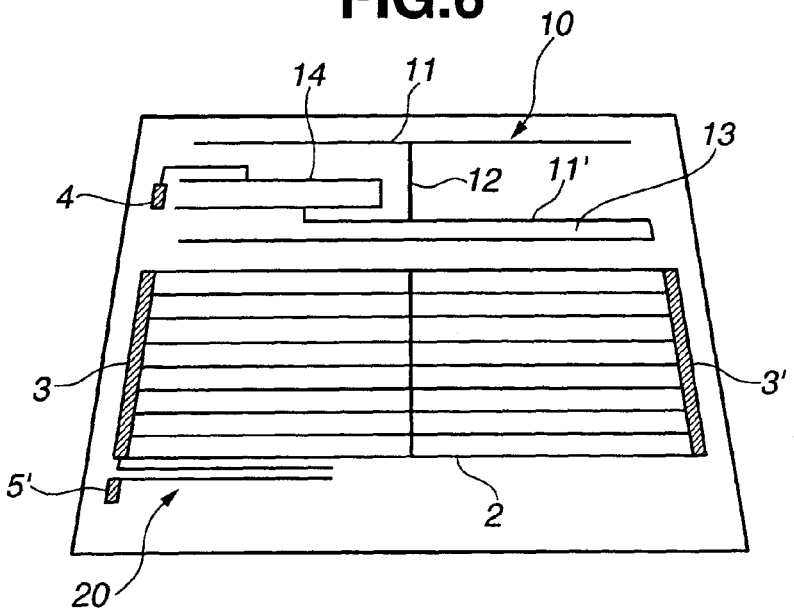
FIG. 6 is a front view showing a conventional glass antenna.
Figure 8:
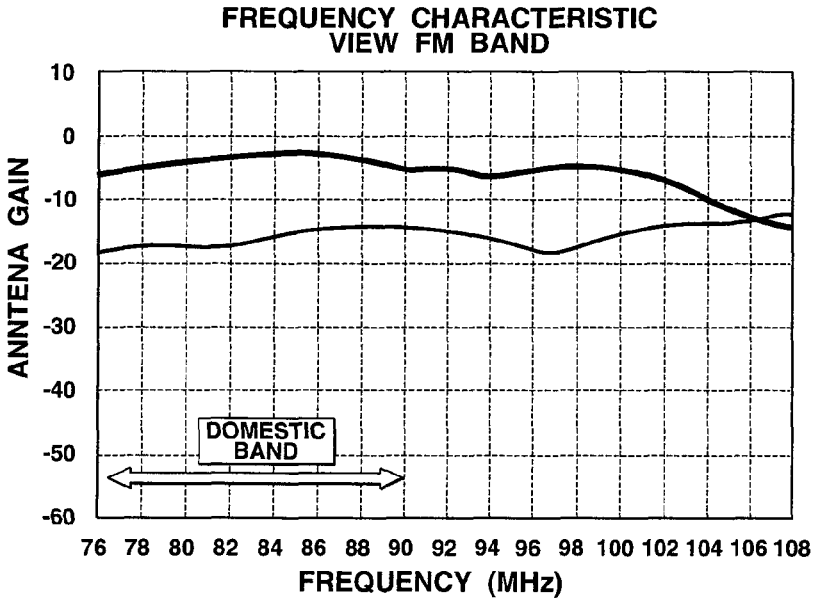
FIG. 8 is a frequency characteristic view of the FM radio broadcast wave band in the conventional glass antenna.

On the other hand, in FIG. 8, in the frequency band of 76-90 MHz of the FM radio broadcast for the Japanese domestic use, a frequency characteristic of the FM radio main antenna 10 alone of a comparative example 1 shown in FIG. 6 is represented by a bold solid line, and a frequency characteristic of the FM radio sub antenna 20 alone is represented by a thin solid line.

In the FM radio main antenna 10, the average reception gain was improved by 0.9 dB from −5.1 dB to −4.2 dB. In the FM radio sub antenna 20, the average reception gain was improved by 2.2 dB from −18.7 dB to −16.5 dB.

As a result, it was found that it was possible to improve the frequency characteristic by the antenna pattern in which the FM radio receiving sub antenna 20 is provided between the two separated horizontal strips 11 and 11 of the FM radio receiving main antenna 10 in the blank space above the heating conductive strips 2, as shown in FIG. 1, relative to the antenna pattern in which the FM radio receiving sub antenna 20 is provided in the blank space below the heating conductive strips as shown in FIG. 6.

Besides, in a case of using for the FM radio broadcast wave of the foreign use of the frequency band of 88-108 MHz, the pattern is set identical to the antenna pattern shown as the Japanese domestic use. The lengths of the elements are adjusted to resonate in the frequency band of 88-108 MHz for the foreign use.

In a case where the FM radio main antenna 10 is provided in the blank space above the heating conductive strips 2 of the rear window glass 1 of the automobile and terrestrial digital broadcast wave receiving antennas are further provided, the distance between the at least two horizontal strips 11 and 11 of the FM radio main antenna 10 is increased, and the terrestrial digital broadcast wave receiving antennas are provided, respectively, at a blank space position between the upper horizontal strip 11 and the U-shaped or the rectangular strip 14 extending from the main feed point 4, at a blank space position between the upper horizontal strip 11 and the FM radio sub antenna 20.

Embodiments

Hereinafter, the present invention will be illustrated in detail with reference to the drawings.

[First Embodiment]

As shown in FIG. 1, the FM radio main antenna 10 and the FM radio sub antenna 20 are provided in the blank space above the heating conductive strips 2 of the rear window glass 1 for the automobile. In the FM radio main antenna 10, the vertical strip 12 connects central portions of the two horizontal strips 11 and 11'. The strip of the lower horizontal strip 11' is bent from a right side end portion in the downward direction, and then returned to provide the return strip 13. Moreover, the strip extending from a left end portion of the lower horizontal strip 11' is connected with a midpoint of the lower strip of U-shaped strip 14. A strip which is bifurcated from the midpoint portion of the upper strip of the U-shaped strip 14, and which extends toward the left side is connected with the main feed point 4.

On the other hand, the FM radio sub antenna 20 is constituted by one horizontal strip 21 extending between the two horizontal strips 11 and 11' of the FM radio main antenna 10 from the sub feed point 5 provided on the right side which is on the side opposite to the main feed point 4.

The glass plate 1 used in the first embodiment has a substantially trapezoid shape. The glass plate 1 has outline dimensions of an upper side of 1100 mm, a lower side of 1,150 mm, and a height of 700 mm. An inside size of the flange of the window flame are an upper side of 1040 mm, a lower side of 1,100 mm, and a height of 650 mm.

A length of the horizontal strip 11 of the FM radio main antenna 10=800 mm, A length of the horizontal strips 11' of the FM radio main antenna 10=810 mm, A length of the vertical strip 12 of the FM radio main antenna 10=130 mm, A length of the return strip 13 of the FM radio main antenna 10=960 mm, A length of the horizontal strip of the U-shaped strip 14 of the FM radio main antenna 10=430 mm, A length of the vertical strip of the U-shaped strip 14 of the FM radio main antenna 10=60 mm A length of the horizontal strip 21 of the FM radio sub antenna 20=440 mm, Distances between the horizontal strips 11 and 11' of the FM radio main antenna 10, and the horizontal strip 21 of the FM radio sub antenna 20=115 mm, 15 mm These FM radio main antenna 10, the FM radio sub antenna 20, the main feed point 4, the sub feed point 5, the bus bars 3 and 3', and the strips of the heating conductive strips 2 are formed by printing on the glass sheet by the conductive paste such as silver paste, and then baking.

The thus-obtained window glass sheet was mounted on the rear window of the automobile. Moreover, the FM radio antenna 10 and the FM radio sub antenna 20 are connected, respectively, from the feed points 4 and 5 through the diversity circuit (not shown) to the FM tuner (not shown) by coaxial cables and so on.

As a result, in the FM radio main antenna 10 shown in FIG. 1, the frequency characteristic shown by the bold solid line of FIG. 7 in the first embodiment of the present invention is improved relative to the conventional frequency characteristic shown by the bold solid line of FIG. 8, and the average reception gain in the first embodiment of the present invention is improved by 0.9 dB from −5.1 dB to −4.2 dB, relative to the conventional antenna.

Moreover, in the FM radio sub antenna 20, the frequency characteristic shown by the thin solid line of FIG. 7 in the first embodiment of the present invention is improved relative to the conventional frequency characteristic shown by the thin solid line of FIG. 8, and the average reception gain in the first embodiment of the present invention is improved by 2.2 dB from −18.7 dB to −16.5 dB, relative to the conventional antenna.

[Second Embodiment]

Figure 2:
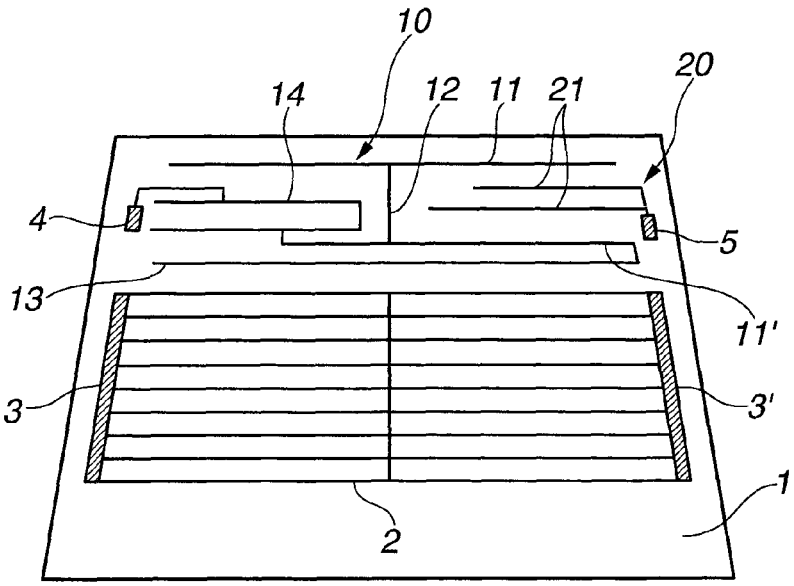
FIG. 2 is a front view showing a glass antenna according to a second embodiment of the present invention.

As shown in FIG. 2, the FM radio main antenna 10 is identical to that of the first embodiment. However, as to the FM radio sub antenna 20, two horizontal strips 21 and 21 are provided, unlike the first embodiment.

Lengths of the horizontal strips 21 and 21 of the FM radio sub antenna 20 are 360 mm and 460 mm. A distance between the horizontal strips 21 and 21 of the FM sub antenna 20 is 70 mm. Distances between the horizontal strips 11 and 11' of the FM radio main antenna 10 and the horizontal strips 21 of the FM radio sub antenna 20 are 30 mm and 35 mm. The other parameters are identical to those of the first embodiment.

These antennas 10 and 20, the feed points 4 and 5, the bus bars 3 and 3', and the heating conductive strips 2 are formed by printing on the glass sheet by the conductive paste such as the silver paste, and then baking The thus-obtained window glass sheet was mounted on the rear window of the automobile. Moreover, the FM radio antenna 10 and the FM radio sub antenna 20 were connected, respectively, from the feed points 4 and 5 through the diversity circuit (not shown) to the FM tuner (not shown) by the coaxial cables and so on. Consequently, it was found that the glass antenna according to the second embodiment has sufficient practical level, like the first embodiment.

[Third Embodiment]

Figure 3:
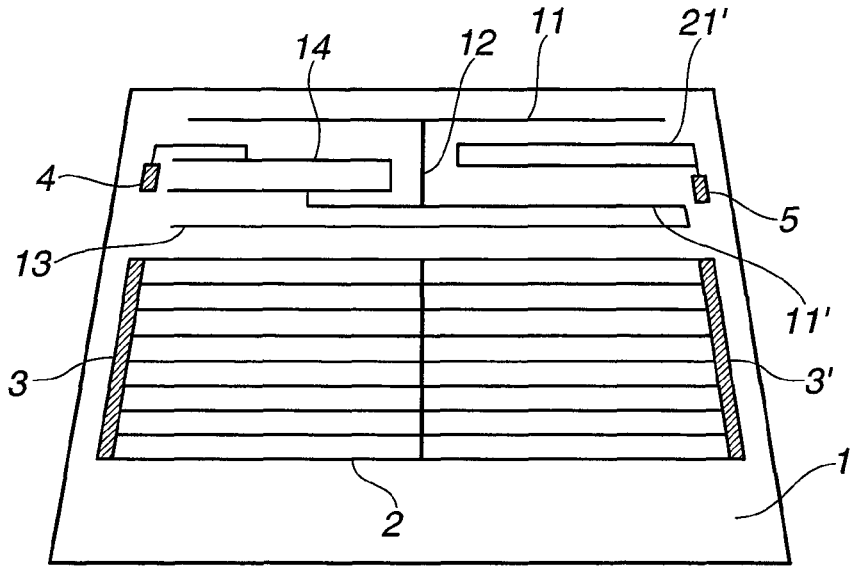
FIG. 3 is a front view showing a glass antenna according to a third embodiment of the present invention.

As shown in FIG. 3, the FM radio main antenna 10 is identical to that of the first embodiment. However, the FM radio sub antenna 20 has a rectangular closed loop shape 21' in place of the horizontal strip 21, unlike the first embodiment.

A length of a transverse side of the closed loop strip 21' of the FM radio sub antenna 20 is 420 mm. A length of a longitudinal side of the closed loop strip 21' of the FM radio sub antenna 20 is 25 mm. Distances between the horizontal strips 11 and 11' of the FM radio main antenna 10 and the closed loop strip 21' of the FM radio sub antenna 20 are 85 mm and 20 mm. The other parameters are identical to those of the first embodiment.

These antennas 10 and 20, the feed points 4 and 5, the bus bars 3 and 3', and the heating conductive strips 2 are formed by printing on the glass sheet by the conductive paste such as the silver paste, and then baking.

The thus-obtained window glass sheet was mounted on the rear window of the automobile. Moreover, the FM radio antenna 10 and the FM radio sub antenna 20 are connected, respectively, from the feed points 4 and 5 through the diversity circuit (not shown) to the FM tuner (not shown) by the coaxial cables and so on. Consequently, it was found that the glass antenna according to the third embodiment has sufficient practical level, like the first embodiment.

[Fourth Embodiment]

Figure 4:
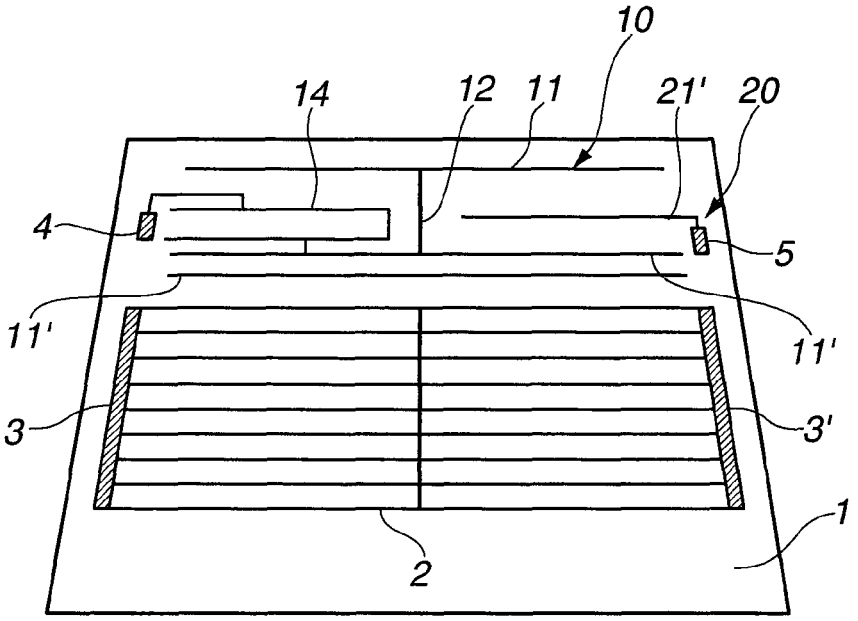
FIG. 4 is a front view showing a glass antenna according to a fourth embodiment of the present invention.

As shown in FIG. 4, the FM radio sub antenna 20 is identical to that of the first embodiment. However, the FM radio main antenna 10 has two lower horizontal strips in place of the return strip returned from the lower horizontal strip, unlike the first embodiment.

Lengths of the lower horizontal strips 11' and 11' of the FM radio main antenna 10 are 955 mm and 960 mm. A length of the vertical strip 12 is 150 mm. The other parameters are identical to those of the first embodiment.

These antennas 10 and 20, the feed points 4 and 5, the bus bars 3 and 3', and the heating conductive strips 2 are formed by printing on the glass sheet by the conductive paste such as the silver paste, and then baking.

The thus-obtained window glass sheet was mounted on the rear window of the automobile. Moreover, the FM radio antenna 10 and the FM radio sub antenna 20 are connected, respectively, from the feed points 4 and 5 through the diversity circuit (not shown) to the FM tuner (not shown) by the coaxial cables and so on. Consequently, it was found that the glass antenna according to the fourth embodiment has sufficient practical level, like the first embodiment.

[Fifth to Eighth Embodiments]

Figure 5:
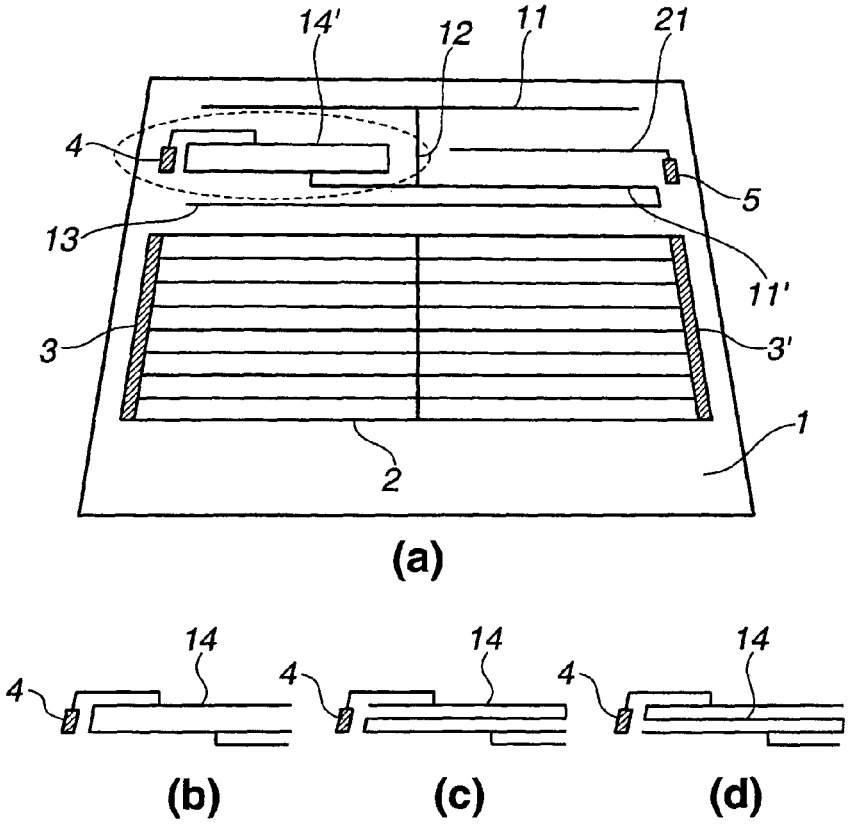
FIGS. 5(*a*)-(*d*) are front views showing glass antennas according to fifth to eighth embodiments of the present invention.

As to fifth to eighth embodiments shown in FIGS. 5(*a*)-(*d*), the FM radio sub antenna 20 is identical to that of the first embodiment. However, the FM radio main antenna 10 according to the fifth embodiment has a rectangular closed loop strip 14' shown in a portion surrounded by a dashed line of FIG. 5(*a*) in place of the U-shaped strip, unlike the first embodiment. The FM radio main antenna 10 according to the sixth embodiment has a reverse U-shaped strip 14 shown in FIG. 5(*b*) in the portion surrounded by the dashed line of FIG. 5(*a*) in place of the U-shaped strip, unlike the first embodiment. The FM radio main antenna 10 according to the seventh embodiment has a strip 14 formed by disposing and superimposing the U-shaped strip and the reverse U-shaped strip at upper and lower positions in the portion surrounded by the dashed line of FIG. 5(*a*) in place of the U-shaped strip, unlike the first embodiment. The FM radio main antenna 10 according to the eighth embodiment has a strip 14 formed by disposing and superimposing the reverse U-shaped strip and the U-shaped strip at upper and lower positions in the portion surrounded by the dashed line of FIG. 5(*a*) in place of the U-shaped strip, unlike the first embodiment.

These antennas 10 and 20, the feed points 4 and 5, the bus bars 3 and 3', and the heating conductive strips 2 are formed by printing on the glass sheet by the conductive paste such as the silver paste, and then baking.

The thus-obtained window glass sheet was mounted on the rear window of the automobile. Moreover, the FM radio antenna 10 and the FM radio sub antenna 20 are connected, respectively, from the feed points 4 and 5 through the diversity circuit (not shown) to the FM tuner (not shown) by the coaxial cables and so on. Consequently, it was found that the glass antenna according to the fifth to eighth embodiments has sufficient practical level, like the first embodiment.

By the above-described glass antennas according to the present invention, the FM radio main antenna and the FM radio sub antenna were provided in the blank space above the defogger of the rear window glass of the automobile to achieve the diversity reception. With this, it was possible to attain the good reception characteristic, and the good directional characteristic.

Moreover, it was possible to considerably decrease the man-hour necessary for the tuning, and to decrease the man-hour for the development, relative to the conventional pattern in which the FM radio sub antenna was provided in the blank space below the defogger. Furthermore, it was possible to simplify the pattern of the FM radio sub antenna.

The invention claimed is:

1. An automotive window antenna which is an AM/FM radio glass antenna provided in a blank space above heating conductive strips of a rear window glass of the automobile, the automotive glass window antenna comprising:

an FM radio main antenna which at least includes at least two horizontal strips that are apart from each other, and a vertical strip connected at positions near substantially central points of the horizontal strips, and which is connected with a main feed point provided on a side of a longitudinal side of the window glass through a strip extending inwardly between the horizontal strips from one end portion or a midpoint portion of one of the horizontal strips; and an FM radio sub antenna which includes at least one horizontal strip, the FM radio sub antenna being provided on a side opposite to the main feed point of the FM radio main antenna, at a substantially central position between the two horizontal strips of the FM radio main antenna, the FM radio sub antenna being apart from the two horizontal strips of the FM radio main antenna so that capacitive coupling effects are negligible, the FM radio sub antenna is connected to a sub feed point that is provided on a longitudinal side of the window glass on a side opposite to the main feed point of the FM radio main antenna, and the at least one FM radio sub antenna horizontal strips being one of a single strip, strips that form sides of a closed loop, and strips that do not form a closed loop and are not linked at ends away from the sub feed point of the FM radio sub antenna, wherein a main one of the at least one horizontal strips of the FM radio sub antenna has a length of 280 mm-400 mm in case of a frequency of 88-108 MHz for foreign band, the sub feed point of the FM radio sub antenna being disposed in the blank space above the heating conductive strips independently of the heating conductive strips, and the FM radio main antenna and the FM radio sub antenna being provided in the blank space above the heating conductive strips to achieve a diversity reception, and being connected to a tuner.

2. The automotive window antenna as claimed in claim 1, wherein the FM radio sub antenna is disposed to be apart from the horizontal strips of the FM radio main antenna by 15 mm or more.

3. The automotive window antenna as claimed in claim 1, wherein the automotive window antenna further comprises a strip of a U-shape, a reverse U-shape, or a rectangular closed shape, or a strip formed by combing these shapes, which is located between a tip end or the midpoint portion of the one of the horizontal strips of the FM radio main antenna, and the main feed point.

4. The automotive window antenna as claimed in claim 1, wherein the FM radio sub antenna includes a rectangular closed loop strip, or a return strip returned from a tip end of the horizontal strip.

* * * * *